US006021537A

United States Patent [19]

Smith

[11] Patent Number: 6,021,537

[45] Date of Patent: Feb. 8, 2000

[54] CLEANING APPARATUS FOR WASHING GOLF CLUBS AND GOLF BALLS

[76] Inventor: Warren K. Smith, 21341 High Country Dr., Trabuco Canyon, Calif. 92679

[21] Appl. No.: 09/088,589

[22] Filed: Jun. 2, 1998

[51] Int. Cl.[7] ..... A63B 47/04; A46B 13/04

[52] U.S. Cl. ..... 15/21.2; 15/21.1

[58] Field of Search ..... 15/21.1, 21.2

[56] References Cited

U.S. PATENT DOCUMENTS

| | | | |
|---|---|---|---|
| 1,602,016 | 10/1926 | Hamilton | 15/21.2 |
| 1,792,211 | 2/1931 | Brewer | 15/21.2 |
| 2,931,058 | 4/1960 | Knudsen | 15/21.2 |
| 3,365,739 | 1/1968 | Olinghouse | 15/21.2 |
| 3,654,655 | 4/1972 | Mitnick | 15/21.2 |
| 4,180,884 | 1/1980 | Hess et al. | 15/21.1 |
| 4,255,826 | 3/1981 | Boyd | 15/21.1 |
| 4,381,574 | 5/1983 | Benkovsky | 15/21.2 X |
| 4,486,911 | 12/1984 | Beke | 15/21.1 |
| 4,676,839 | 6/1987 | Osborn | 15/21.1 X |
| 4,951,339 | 8/1990 | Braun | 15/88.3 |
| 5,224,233 | 7/1993 | Rich | 15/88.3 |
| 5,546,629 | 8/1996 | Shim | 15/21.2 X |
| 5,560,066 | 10/1996 | McDivitt | 15/88.3 |
| 5,894,619 | 4/1999 | Hougland et al. | 15/21.1 |

*Primary Examiner*—Mark Spisich
*Attorney, Agent, or Firm*—Eric K. Karich

[57] ABSTRACT

A cleaning apparatus for golf balls and golf club heads has a base portion that houses a motor, the base portion being adapter to removably engage a receiver housing containing a rotatably mounted brush. The motor removably and operably engages the brush through a plurality of gears that are brought into operable engagement when the receiver housing removably engages the base portion. The receiver housing is then filled with cleaning fluid and the user can wash his clubs in the cleaning fluid by holding the clubs against the brush as the motor causes the brush to rotate. A golf ball cassette filled with dirty golf balls can also be inserted into the receiver housing. The rotation of the brush drives the dirty golf balls in a circular pattern, causing them to be cleaned by top and bottom ball wash brushes of the golf ball cleaning cassette.

4 Claims, 5 Drawing Sheets

CLEANING APPARATUS FOR WASHING GOLF CLUBS AND GOLF BALLS

BACKGROUND OF THE INVENTION

This application is based on Document Disclosure Program file # 435755.

1. Field of the Invention

This invention relates generally to a cleaning apparatus for golf equipment, and more particularly to a portable and power driven cleaning apparatus that can be used to golf clubs and golf balls.

2. Description of Related Art

A common problem faced by all golfers is the problem of dirty clubs and golf balls. Due to the nature of the game, golf equipment tends to get dirty after even a short round of golf. Cleaning this golf equipment can be a cumbersome chore. If the equipment is not cleaned properly, it will not only contaminate your car when you bring the equipment home, it will also potentially hurt your golf game. If your balls are dirty, they may reduce the range of your drives. If your clubs have mud caked on their striking face, the contamination may reduce the club's driving power.

Machines having motor driven brushes for cleaning are known in the art. Prior art devices have tended, however, to be large, complicated, and cumbersome devices which have to be plugged into a power source before they can be used. An example of recent prior art includes Rich, U.S. Pat. No. 5,224,233, which discloses a machine for cleaning golf club heads with a motor driven brush that can be submersed in a bucket of water. McDivitt, U.S. Pat. No. 5,560,066, discloses a portable golf club cleaner, but this motor driven brush relies on a complex spraying system to wash the golf club head with water.

The primary reference is Braun, U.S. Pat. No. 4,951,339, that discloses a portable motor powered cleaning assembly somewhat similar in function to the present invention. The Braun cleaning assembly utilizes a rotary scrub brush that is directly powered by a motor, both elements located in a single housing. A separate cleaning chamber containing cleaning fluid can be attached to the assembly, but the brush is permanently mounted. When the wet and dirty brush is attached within the same chamber as the motor and power supply, cleanup is made very difficult. Furthermore, the user is in danger of damaging the electric motor or even electrocuting himself.

None of these motor driven devises teach an apparatus that will also clean golf balls. Without such a capability, the user of prior art devices is left to clean his golf balls in a standard, hand-driven cleaning machine.

The prior art teaches a portable, motor driven golf club cleaning apparatus. However, the prior art does not teach a cleaning apparatus that is cheap, easy to manufacture, portable, easy to clean and maintain, and safe to use. The prior art also does not teach a method of cleaning golf balls within the same apparatus. The present invention fulfills these needs and provides further related advantages as described in the following summary.

SUMMARY OF THE INVENTION

The present invention teaches certain benefits in construction and use which give rise to the objectives described below.

The present invention provides a cleaning apparatus for golf balls and golf club heads. The apparatus has a base portion that houses a motor, the base portion being adapter to removably engage a receiver housing containing a rotatably mounted brush. The motor removably and operably engages the brush through a motor engagement means. The receiver housing is then filled with cleaning fluid and the user can wash his clubs in the cleaning fluid by holding them against the rotating brush. A golf ball cassette filled with dirty golf balls can also be inserted into the receiver housing. The rotation of the brush drives the dirty golf balls in a circular pattern, causing them to be cleaned by top and bottom ball wash brushes of the golf ball cleaning cassette.

A primary objective of the present invention is to provide a motor powered cleaning apparatus that can be used to clean golf balls as well as golf club heads, the apparatus having advantages not taught by the prior art.

Another objective is to provide a cleaning apparatus with a motor powered brush, with the motor being located in a housing separate from the brush and the cleaning fluid.

A further objective is to provide a golf ball cassette that enables the user of the cleaning apparatus to easily clean his golf balls with the same motor driven brush.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
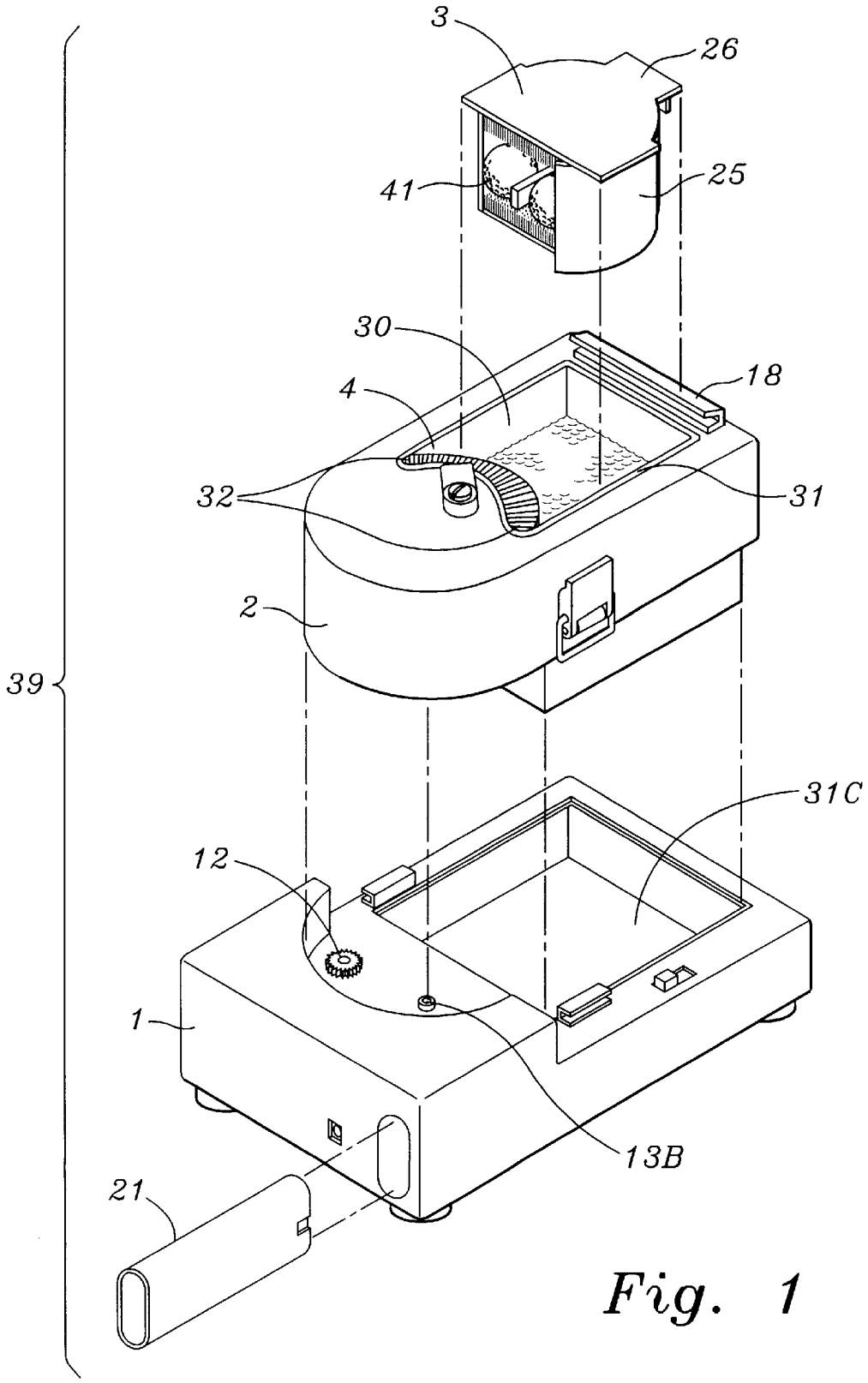
FIG. 1 is an exploded perspective view of the preferred embodiment of the present invention, showing a golf ball cassette fitting into an inner wash chamber.

The above described drawing figures illustrate the invention, a cleaning apparatus 39 for golf balls and golf club heads. As shown in FIG. 1, the apparatus has a base portion 1 that houses a motor 5, the base portion 1 being adapter to removably engage a receiver housing 2 containing a rotatably mounted brush 4. The motor 5 removably and operably engages the brush 4 through a motor engagement means 9. The receiver housing 2 is then filled with cleaning fluid 15 and the user can wash his clubs in the cleaning fluid 15 by holding them against the rotating brush 4. Once his golf clubs are clean, the user can then use the apparatus to clean his dirty golf balls 41. A golf ball cassette 3 full of dirty golf balls 41 is inserted into the receiver housing 2, bringing the brush 4 into contact with the golf balls 41 for cleaning. The rotating brush 4 scrubs the golf balls 41 directly. The rotary action of the brush 4 also moves the balls in a circular pattern throughout the cassette, further cleaning the golf balls 41. The golf ball cassette 3 and the receiver housing 2 with the brush 4 are ready removable from the base portion 1, facilitating easy cleanup. The cleaning apparatus 39 is preferably relatively small, sturdy, and lightweight, to facilitate its portability. It is preferably constructed of a lightweight and durable material such as plastic, and it is preferably approximately 13 inches wide, 5 inches high, and 8 inches deep.

Figure 3:
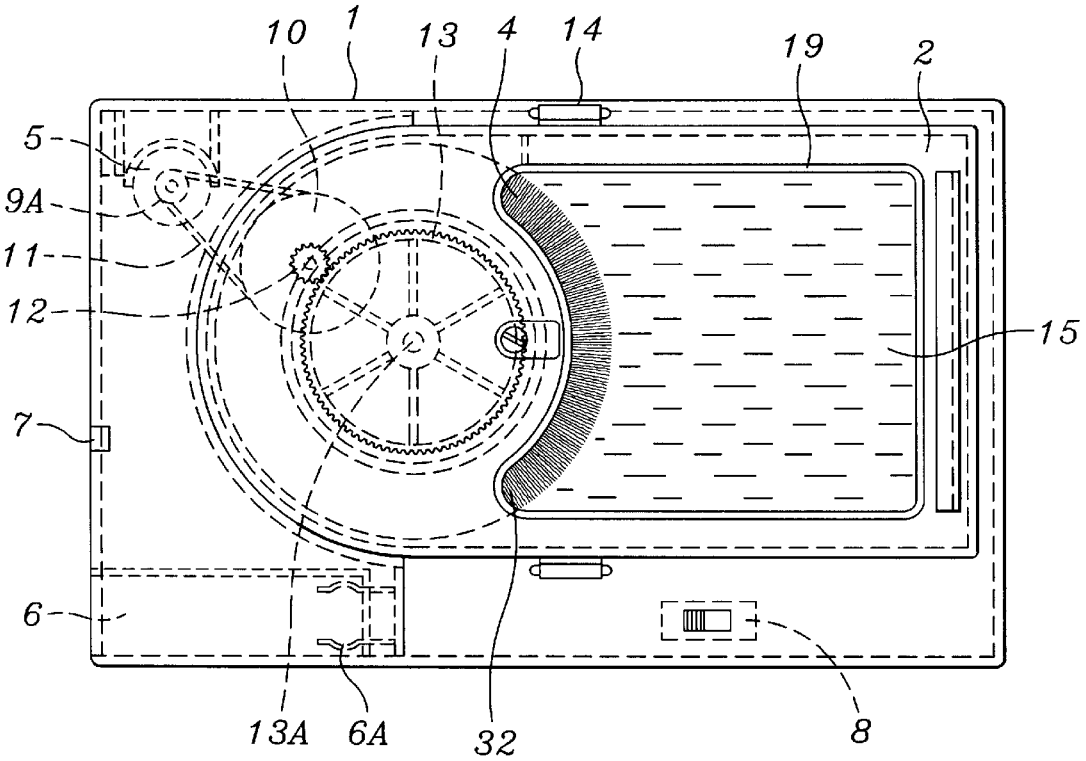
FIG. 3 is a plan view thereof, showing the internal components of the base portion and the receiver housing.
Figure 4:
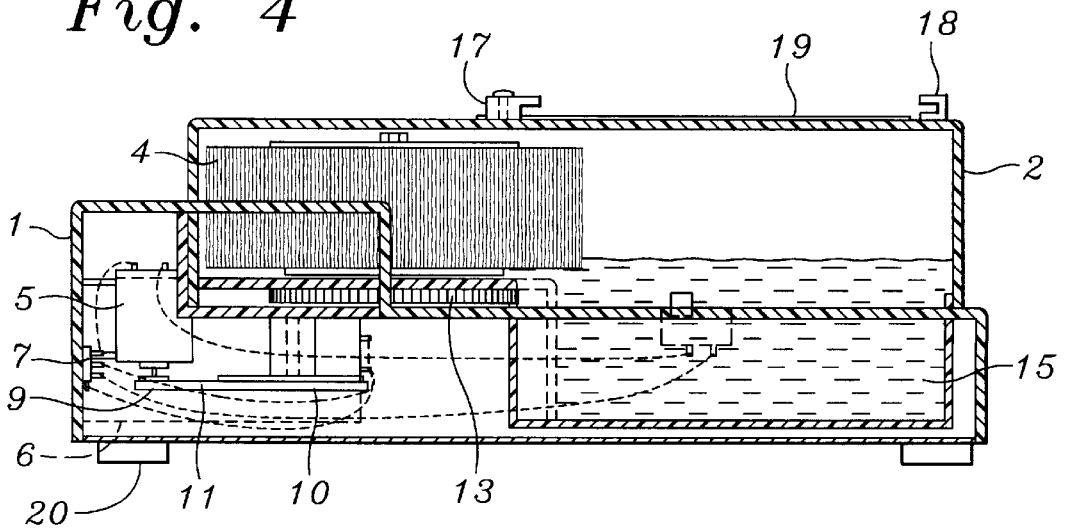
FIG. 4 is a front elevational sectional view thereof.

FIG. 1 shows the base portion 1 as it interrelated with the rest of the cleaning apparatus 39. As shown in FIGS. 3 and 4, the base portion 1 of the apparatus houses the drive means. While many drive means may be devised by those skilled in the art, the drive means 5 is preferably an electric motor. The base portion 1 further contains a power source for the electric motor 5, preferably a rechargeable battery 21 that fits into a battery receptor 6 of the base portion 1. The battery receptor 6 is preferably a recess sized and shaped to receive a common rechargeable battery 21. The inner end of the battery receptor 6 contains a electrically conductive contact 6A. When the user inserts the rechargeable battery 21 into the battery receptor 6, the rechargeable battery 21 is electronically connected to the electric motor through the contact 6A. In its preferred mode, the base portion 1 also contains and an electrical connection means for electronically connecting the electric motor 5 to an outside power supply. The electrical connection means is preferably a DC adapter receptor 7. The circuit connecting the rechargeable battery 21 and the DC adapter receptor 7 to the electric motor 5 preferably includes an on-off switch 8. The on-off switch 8 is preferably a simple switch located on the exterior of the base portion 1. However, in an alternative embodiment, the on-off switch 8 is a foot actuated switch as described in Braun, U.S. Pat. No. 4,951,339, hereby incorporated by reference in full. Finally, the base portion 1 preferably includes a plurality of stabilizing pads 20, preferably made of a flexible material such as rubber. The base portion 1 rests on the stabilizing pads 20, and the stabilizing pads 20 provide a sturdy, slip resistant foundation for the cleaning apparatus 39.

Figure 2:
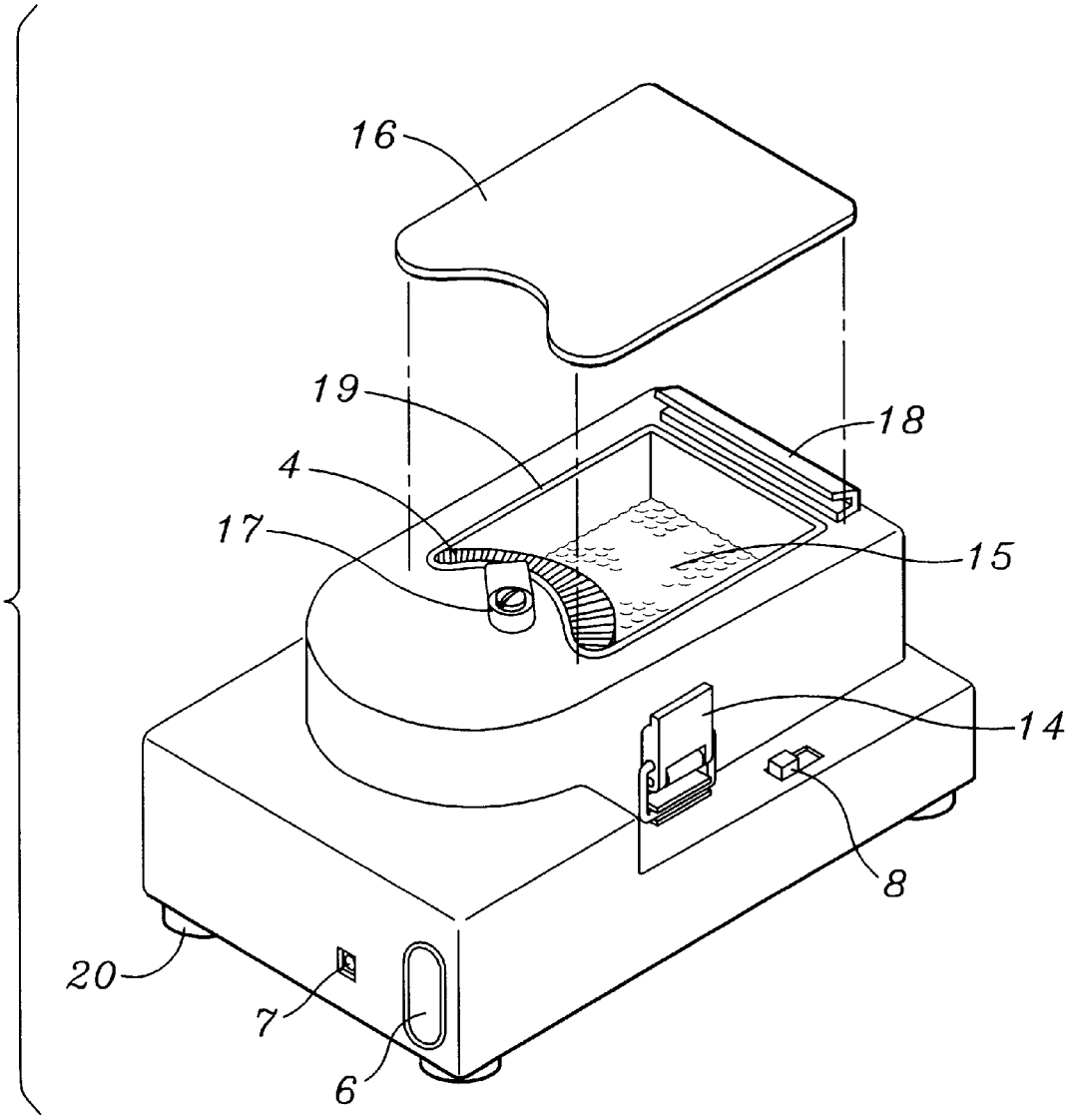
FIG. 2 is a partially exploded perspective view thereof, showing the golf ball cassette removed and a water tight lid used to cover an aperture.
Figure 5:
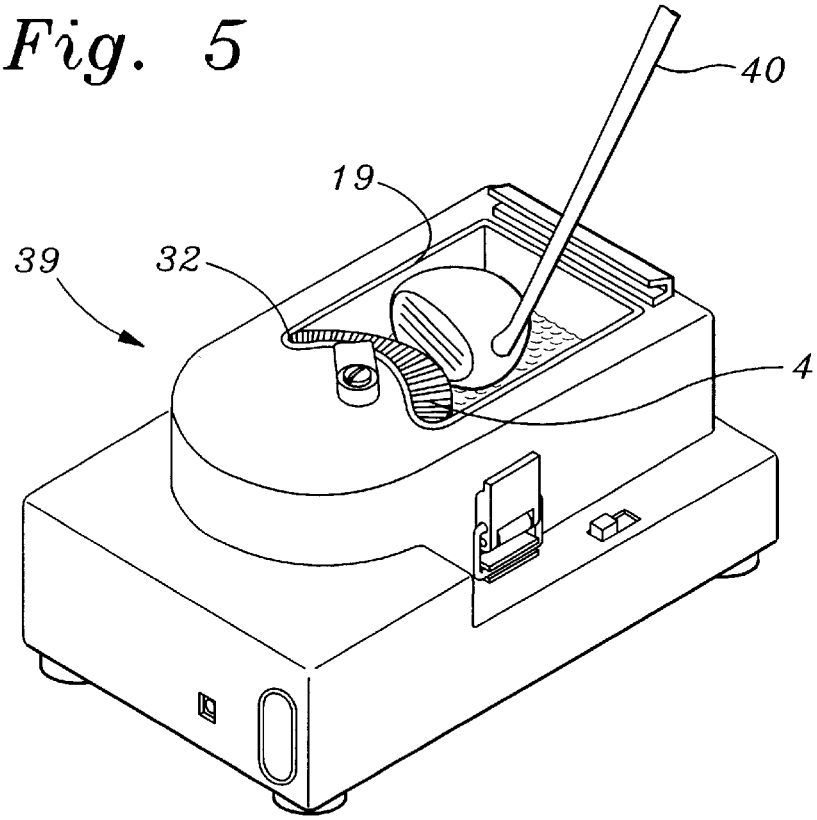
FIG. 5 is a perspective view of the receiver housing engaged with the base portion, showing how the apparatus is used to clean the face of a wood driver.

As shown in FIG. 1, the receiver housing 2 rotatably mounts a brush 4 within an inner wash chamber 30 of the receiver housing 2. The receiver housing 2 has a top aperture 31 communicating with the inner wash chamber 30. In use, the inner wash chamber 30 is filled with cleaning fluid 15. The user inserts the golf club 40 through the top aperture 31 and into the cleaning fluid 15 of the wash chamber. As shown in FIG. 5, the user then places the golf club 40 against the rotating brush 4 within the wash chamber, thereby cleaning the club. The top aperture 31 is preferably large enough to accept the larger clubs known as woods. The top aperture 31 preferably includes a pair of shaft slots 32 adjacent to the brush 4, the shaft slots 32 allowing the user to insert the golf club 40 at an angle to clean the striking face of the golf club 40. The top aperture 31 preferably has a resilient strip 19 attached to its perimeter. The resilient strip 19 is preferably made of plastic or rubber. The resilient strip 19 protects the shaft of the golf club 40 from being damaged when the golf club 40 is being cleaned. The resilient strip 19 also cooperated with a water tight lid 16 to seal the top aperture 31 when the apparatus is not in use, and especially to facilitate transport of the apparatus without spilling the cleaning fluid 15. The water tight lid 16 can be fastened in place with many fastening devices well known in the art. The water tight lid 16 is preferably held in place over the top aperture 31 through the cooperation of a lid hold down lip 18 and a lid latch 17. The lid hold down lip 18 is preferably a lip that is integral with the receiver housing 2. The lid latch 17 is preferably a locking arm that rotates between locking and unlocking positions. As shown in FIG. 2, one end of the water tight lid 16 fits under the lid hold down lip 18 and the other end fits against the lid latch 17. By rotating the lid latch 17 to a locked position, the lid latch 17 rotates to cover the water tight lid 16, thereby locking it into position.

The motor 5 is removably engagable to the brush 4 with a motor engagement means 9. The motor engagement means 9, as shown in FIG. 3; preferably includes a motor pulley 9A operably engaged to the motor 5. The motor pulley 9A is operably engaged to a drive pulley 10 with a drive belt 11. The drive pulley 10 is operably engaged to a pinion gear 12 12, the pinion gear 12 being rotatably mounted on the exterior of the base portion 1. The pinion gear 12 is preferably on a housing receiving portion 31C of the exterior of the base portion 1 adjacent to a pin locking hole 13B. The pinion gear 12 removably engages a drive gear 13 rotatably mounted beneath the receiver housing 2. To achieve this engagement, the receiver housing 2 is preferably shaped to removably engages the base portion I of the apparatus. The receiver housing 2 preferably includes a pair of hold down clips 14 that removably engage with a pair of clip locking lips 14A to removably lock the base portion 1 to the receiver housing 2. When the receiver housing 2 is engaged with the base portion 1, a central pin 13A extending from the center of the drive gear 13 fits into the pin locking hole 13B in the housing receiving portion 31C of the base portion 1. This configuration places the pinion gear 12 in operable engagement with the drive gear 13. The drive gear 13 is operably engaged with the brush 4, such that rotation of the drive gear 13 results in the rotation of the brush 4. This motor engagement means 9 is one of the critical innovations of this invention, allowing the brush 4 to be power driven, but separate from the motor 5 and its electrical components.

Figure 6:
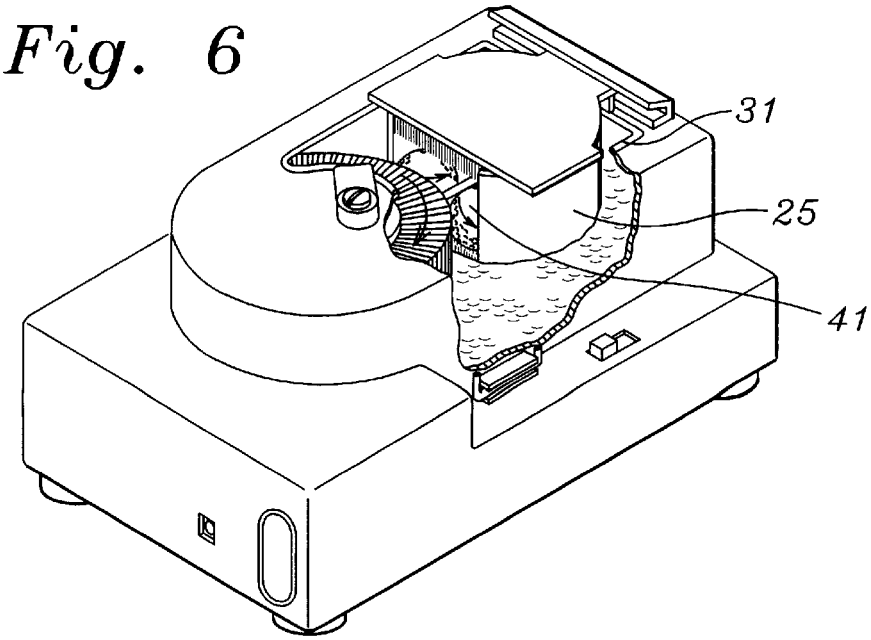
FIG. 6 is a perspective view thereof, showing the golf ball cassette engaged within the receiver housing, the receiver housing being partially cut away to show how the brush contacts the golf balls within the golf ball cassette.
Figure 7:
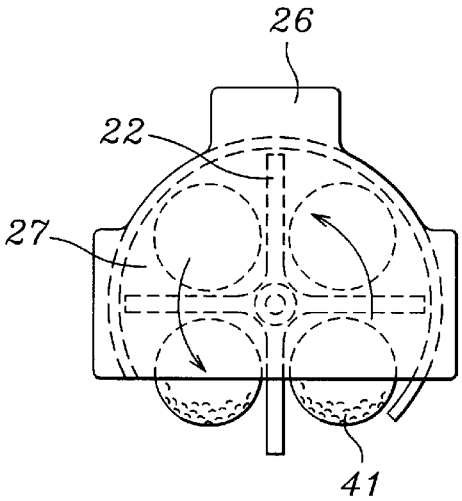
FIG. 7 is a plan view of the golf ball cassette, showing how the ball wash carousel moves the balls in circles within the golf ball cassette.
Figure 8:
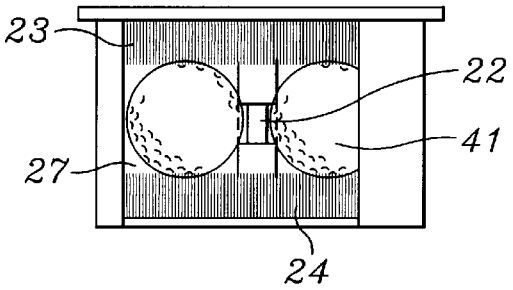
FIG. 8 is a front elevational view thereof.
Figure 9:
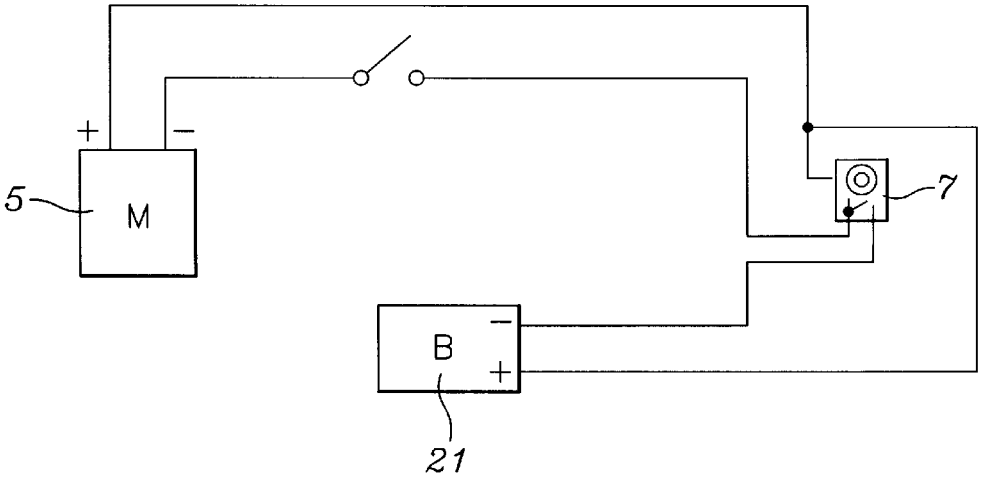
FIG. 9 is an electronic block diagram of the motor and its power source.

In its preferred mode, as shown in FIGS. 1 and 6, the apparatus further includes a golf ball cassette 3 for cleaning golf balls 41. The golf ball cassette 3, as shown in FIGS. 7 and 8, includes a top ball wash brush 23 and a bottom ball wash brush 24 integrally connected with a cassette sidewall 25 to define an interior ball scrubbing chamber 27. A ball wash carousel 22 is rotatably mounted within the interior ball scrubbing chamber 27. A plurality of golf balls 41 fit into the interior ball scrubbing chamber 27 separated by the arms of the ball wash carousel 22. The top and bottom ball wash brushes 23 and 24 are separated by a distance slightly less than the diameter of the golf balls 41, so movement of the golf balls 41 within the interior ball scrubbing chamber 27 results in the golf ball 41 being scrubbed by the top and bottom ball washing brushes 23 and 24. As shown in FIG. 6, the golf ball cassette 3 is shaped for engagement within the receiver housing 2 so as to position the brush 4 for cleaning the golf balls 41 that are positioned within the a golf ball cassette 3. The top and bottom ball washing brushes 23 and 24 and the connecting cassette sidewall 25 are sized to fit through the top aperture 31 and within the inner wash chamber 30. The golf ball cassette 3 further includes a cassette locking lip 26 that engages the lid hold down 18 to hold the golf ball cassette 3 in place. In addition to the brush 4 cleaning the golf balls 41 within the golf ball cassette 3, the rotation of the brush 4 also rotates the ball wash carousel 22, moving the golf balls 41 in a circular pattern between the top ball wash brush 23 and the bottom ball wash brush 24, further cleaning the golf balls 41 as described above.

In operation, the user places the receiver housing 2 into the housing receiving portion 31C of the base portion 1, operably engaging the motor 5 to the brush 4. The user then locks the pair of hold down clips 14 to their mating clip locking lips 14A, thereby locking the receiver housing 2 to the base portion 1. The user then fills the inner wash chamber 30 of the receiver housing 2 with cleaning fluid 15 and inserts a rechargeable battery 21 into the battery receptor 6, electrically connection the rechargeable battery 21 with the motor 5 through the contact 6A. Alternatively, the user can plug the apparatus into an AC power supply connected to a DC adapter, which plugs into the DC adapter receptor 7. Once the user has turned the on-off switch 8 to its operating position, the motor 5 rotatably drives the brush 4. The user can then insert a dirty club 40 through the top aperture 31 and into the inner wash chamber 30, where the golf club 40 can be cleaned with the cleaning fluid 15 and the rotating brush 4. The user can then remove the golf club 40, fill the golf ball cassette 3 with dirty golf balls 41, and insert the golf ball cassette 3 into the inner wash chamber 30, where the rotation of the brush 4 causes the golf balls 41 to move in a circular pattern within the golf ball cassette 3 as guided by the ball wash carousel 22. Once the user has washed all of his golf equipment, he can remove both the golf ball cassette 3 and the receiver housing 2 and wash both of the units separately from each other and the motor 5. The receiver housing 2 can then be refilled with cleaning fluid 15 and the top aperture 31 can be sealed with the water tight lid 16. In this configuration, the apparatus is easily portable and can be stored in a convenient location for future use.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A cleaning apparatus for golf balls and golf club heads, the apparatus comprising:

a base portion having a motor;

a receiver housing rotatably mounting a brush within an inner wash chamber of the receiver housing, the receiver housing having a top aperture communicating with the inner wash chamber;

the motor being removably engagable to the brush with a motor engagement means; and a golf ball cassette having a top ball wash brush and a bottom ball wash brush integrally connected with a cassette sidewall to define an interior ball scrubbing chamber, a ball wash carousel rotatably mounted within the interior ball scrubbing chamber, and the golf ball cassette being shaped for engagement within the receiver housing so as to position the brush for cleaning the golf balls, the brush further rotating the ball wash carousel, moving the golf balls around between the top ball wash brush and the bottom ball wash brush, thereby scrubbing the golf balls.

2. A cleaning apparatus for golf balls and golf club heads, the apparatus comprising:

a rotatable brush positioned within a receiver housing and adapted for rotating the brush therein;

a separable golf ball cassette adapted for holding a plurality of golf balls in a ball wash carousel rotatably mounted therein;

the golf ball cassette shaped for engagement within the receiver housing so as to position the brush for cleaning the golf balls.

3. The apparatus of claim 2 wherein the receiver housing is separable from a base portion of the apparatus, the rotatable brush providing a motor engagement means for disengagement from a motor positioned within the base portion.

4. The apparatus of claim 3 wherein with the golf ball cassette removed from the receiver housing, the brush is exposed for cleaning the face of a golf club head.

* * * * *